US008795473B2

(12) United States Patent
Wicks et al.

(10) Patent No.: US 8,795,473 B2
(45) **Date of Patent: *Aug. 5, 2014**

(54) TUBE BANK APPARATUS FOR DISTRIBUTING STOCK

(75) Inventors: Laurie D Wicks, South Beloit, IL (US); Greg Weicher, Rockton, IL (US); James L Ewald, Stuart, FL (US)

(73) Assignee: Paperchine Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/589,318

(22) Filed: Oct. 21, 2009

(65) Prior Publication Data

US 2010/0108281 A1 May 6, 2010

Related U.S. Application Data

(63) Continuation-in-part of application No. 12/316,369, filed on Dec. 11, 2008, now Pat. No. 7,955,474.

(60) Provisional application No. 61/007,149, filed on Dec. 11, 2007.

(51) Int. Cl.
*D21F 1/00* (2006.01)

(52) U.S. Cl.
USPC ..... 162/343

(58) Field of Classification Search
USPC ..... 162/343, 336, 212, 216
See application file for complete search history.

(56) References Cited

U.S. PATENT DOCUMENTS

| | | | | | |
|---|---|---|---|---|---|
| 5,183,537 | A * | 2/1993 | Hergert et al. | ..... | 162/216 |
| 5,196,091 | A * | 3/1993 | Hergert | ..... | 162/258 |
| 5,626,722 | A * | 5/1997 | Huovila | ..... | 162/343 |
| 5,792,321 | A * | 8/1998 | Aidun | ..... | 162/216 |
| 6,406,595 | B1 * | 6/2002 | Aidun | ..... | 162/216 |
| 6,610,175 | B2 * | 8/2003 | Aidun | ..... | 162/336 |
| 6,902,651 | B2 * | 6/2005 | Fujiki et al. | ..... | 162/343 |
| 2003/0178167 | A1 * | 9/2003 | Fujiki et al. | ..... | 162/212 |

* cited by examiner

*Primary Examiner* — Mark Halpern
(74) *Attorney, Agent, or Firm* — David J. Archer

(57) ABSTRACT

A tube bank apparatus is disclosed for distributing stock in a headbox of a papermaking machine. The apparatus includes a tube having a first and a second portion for the flow therethrough of the stock. The first portion defines a bore for the flow therethrough of the stock, the bore having an upstream and a downstream end. The second portion defines a passage for the flow therethrough of the stock, the passage having an upstream and a downstream extremity. The upstream extremity of the passage cooperates with the downstream end of the bore so that the stock flows from the upstream end to the downstream end of the bore and then through the upstream extremity and then the downstream extremity of the passage. A first, second and third edge define at least a part of the downstream extremity of the passage, the second edge extending between the first edge and the third edge such that a sum of a first angle defined between the first edge and the second edge and a second angle defined between the second edge and third edge is less than 180 degrees.

15 Claims, 3 Drawing Sheets

TUBE BANK APPARATUS FOR DISTRIBUTING STOCK

CROSS REFERENCE TO RELATED APPLICATION.

The subject application is a Complete application filed pursuant to the Provisional application filed by Express Mail EH 018834773 US Feb. 24, 2009 and is a CIP of U.S. Ser. No. 12/316,369 filed Dec. 11, 2008, now U.S. Pat. No . 7,955,474, and is filed pursuant to Provisional application U.S. Ser. No. 61/007149 filed Dec. 11, 2007. All the disclosure of the aforementioned applications is incorporated herein by reference.

BACKGROUND OF THE INVENTION

1. Field of the Invention

The present invention relates to a tube bank apparatus for distributing stock.

More specifically, the present invention relates to a tube bank apparatus for distributing stock in a headbox of a papermaking machine.

2. Background Information

A conventional headbox distributor uses a tube array to spread the pulp slurry as uniformly as possible across the width of a paper machine headbox prior to the start of the drainage or other thickening process. The tube array is made up of individual round inlet tubes mounted in some manner to cause acceleration of the flow into each tube from a cross machine header or other form of supply of the slurry prior to the tube array. The pressure drop from the acceleration of the flow at the inlet of each tube within the array is critical to the uniformity of the flow within each tube and therefore to the uniformity of the cross machine uniformity of the headbox in general. This acceleration of the flow is also a factor in the operational cleanliness of the headbox operation. The exit end of each individual tube must permit the flow of slurry to be re-joined prior to or within the nozzle of the headbox prior to discharge to the drainage area. The reorientation of the round tube entrance flow to the prior art eventual rectangular shape of the nozzle will create disturbances in the flow in all directions. These disturbances must be damped or reduced in some way prior to discharge out the slice so as not to cause nonuniformities in the paper web.

The purpose of this invention is to create the necessary pressure drop and subsequent uniform cross machine flow distribution while minimizing the wall effects of the individual tubes prior to the rejoining of the flows in the nozzle. According to the present invention, the discharge end of each tube is of a triangular or trapezoidal shape with alternate tube triangular or trapezoidal shapes disposed vertically opposite to each other. These triangular or trapezoidal shaped tubes are nested together to form a close packed array on the discharge end, with little or no vertical wall continuous in any area across the width of the headbox. To make the edge effect minimal to the pond sides a special tube can be supplied on each end which has one side the same angle as the two sides of the triangular or trapezoidal discharges and the other side vertical. These end tubes may be larger in the discharge area than the rest of the tubes and subsequently may have a larger inlet as well. Additionally, this larger inlet may have an adjustable insert for flow and fiber orientation control.

The invention uses a distributor consisting of simple round inlet tubes expanding to a round expansion area then to a triangular or trapezoidal area with a cross-sectional area slightly less than a cross-sectional area of the round expansion area. This round to triangular or trapezoidal shape allows for some acceleration of the flow toward the discharge of the tube, yet minimizes the vertical open area change between tubes by slanting the wall area between tubes.

This invention will reduce cross machine non uniformity of both consistency and velocity of the stock flow. The present invention is useful for all grades of paper or tissue, and is usable with or without the inclusion of flow turbulence control sheets. The apparatus according to the present invention is usable with or without the use of consistency dilution control. Also, the present invention is adaptable for using different entrance diameters of the tube array which will alter the in-going velocities.

Therefore, the primary feature of the present invention is the provision of a tube bank apparatus for distributing stock in a headbox of a papermaking machine that overcomes the problems associated with the prior art arrangements and which makes a significant contribution to the papermaking art.

Another feature of the present invention is the provision of a tube bank apparatus for distributing stock in a headbox of a papermaking machine that reduces cross machine non uniformity of both consistency and velocity.

Yet another feature of the present invention is the provision of a tube bank apparatus for distributing stock in a headbox of a papermaking machine that increase the operational cleanliness of the headbox operation.

Other features and advantages of the present invention will be readily apparent to those skilled in the art by a consideration of the detailed description of a preferred embodiment of the present invention contained herein.

SUMMARY OF THE INVENTION

The present invention relates to a tube bank apparatus for distributing stock in a headbox of a papermaking machine. The apparatus includes a tube having a first and a second portion for the flow therethrough of the stock. The first portion defines a bore for the flow therethrough of the stock, the bore having an upstream and a downstream end. The second portion defines a passage for the flow therethrough of the stock, the passage having an upstream and a downstream extremity. The upstream extremity of the passage cooperates with the downstream end of the bore so that the stock flows from the upstream end to the downstream end of the bore and then through the upstream extremity and then the downstream extremity of the passage. A first, second and third edge define at least a part of the downstream extremity of the passage. The second edge extends between the first edge and the third edge such that a sum of a first angle defined between the first edge and the second edge and a second angle defined between the second edge and third edge is less than 180 degrees.

In a more specific embodiment of the present invention, the tube is fabricated from metal.

More specifically, the tube is fabricated from stainless steel.

Additionally, the bore is of uniform cross-sectional area from the upstream end to the downstream end thereof.

Also, the bore is of circular cross-section from the upstream end to the downstream end thereof.

The upstream extremity of the passage is of circular cross-sectional configuration and the circular cross-sectional configuration of the upstream extremity has an area which is greater than a further area of the cross-section of the downstream extremity of the passage.

Furthermore, the downstream extremity of the passage includes the first, second and third edge.

Additionally, the first angle defined between the first edge and the second edge is approximately equal to the second angle defined between the second edge and the third edge.

A plurality of further tubes is provided with each further tube being substantially identical in configuration to the tube.

The tube and a laterally adjacent further tube of the plurality of further tubes are nested relative to each other with the further tube being inverted relative to the tube so that any disturbances generated within each tube prior to discharge of the flow of stock from the tubes are minimized.

Additionally, the tube and further tubes define a row of tubes.

A further row of tubes is provided substantially identical to the row of tubes. The further row is disposed parallel and adjacent to the row of tubes and at a different elevation relative to the row of tubes.

Also, an edge tube has a first and a second part for the flow therethrough of the stock. The first part defines a channel for the flow therethrough of the stock. The channel has an upstream and a downstream termination.

The second part of the edge tube defines a conduit for the flow therethrough of the stock. The conduit has an upstream and a downstream boundary. The upstream boundary of the conduit cooperates with the downstream termination of the channel so that the stock flows from the upstream termination to the downstream termination of the channel and then through the upstream boundary and then the downstream boundary of the conduit.

Also, the downstream termination of the channel has a cross-sectional area which is less than a further cross-sectional area of the upstream boundary of the conduit.

Furthermore, the downstream boundary of the conduit has a cross-section of triangular configuration.

Also, the upstream termination of the edge tube has a larger cross sectional area than the cross sectional area of the upstream end of the tube or further tubes.

The downstream boundary of the conduit includes a first, second and third side.

Additionally, the first side defines an angle relative to the second side.

Also, the second side defines a further angle relative to the third side. The angle and further angle are different from each other so that the edge tube nests between a pond side of the headbox and an adjacent edge of an adjacent tube.

An adjustable insert is disposed within the upstream termination for adjustably restricting the flow through the edge tube for controlling the flow and fiber orientation downstream relative to the tube bank apparatus.

A dilution control apparatus is operatively connected to the tube bank apparatus for controlling the consistency of stock flowing through at least some of the tubes of the tube bank apparatus for thus reducing the cross machine nonuniformities in consistency of a resultant web.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
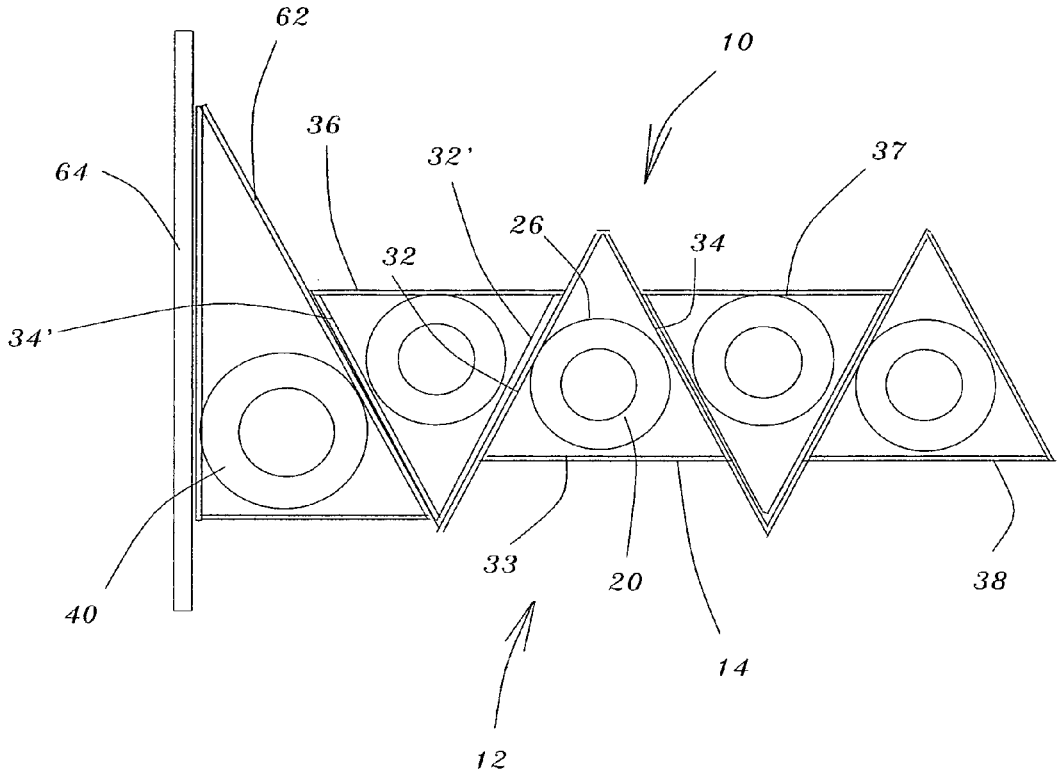
FIG. 1 is a front view of a tube bank apparatus according to the present invention for distributing stock in a headbox of a papermaking machine.

FIG. 1 is a front view of a tube bank apparatus generally designated 10 for distributing stock in a headbox generally designated 12 of a papermaking machine. As shown in FIG. 1, the tube bank 10 includes a plurality of tubes such as tube 14.

Figure 2:
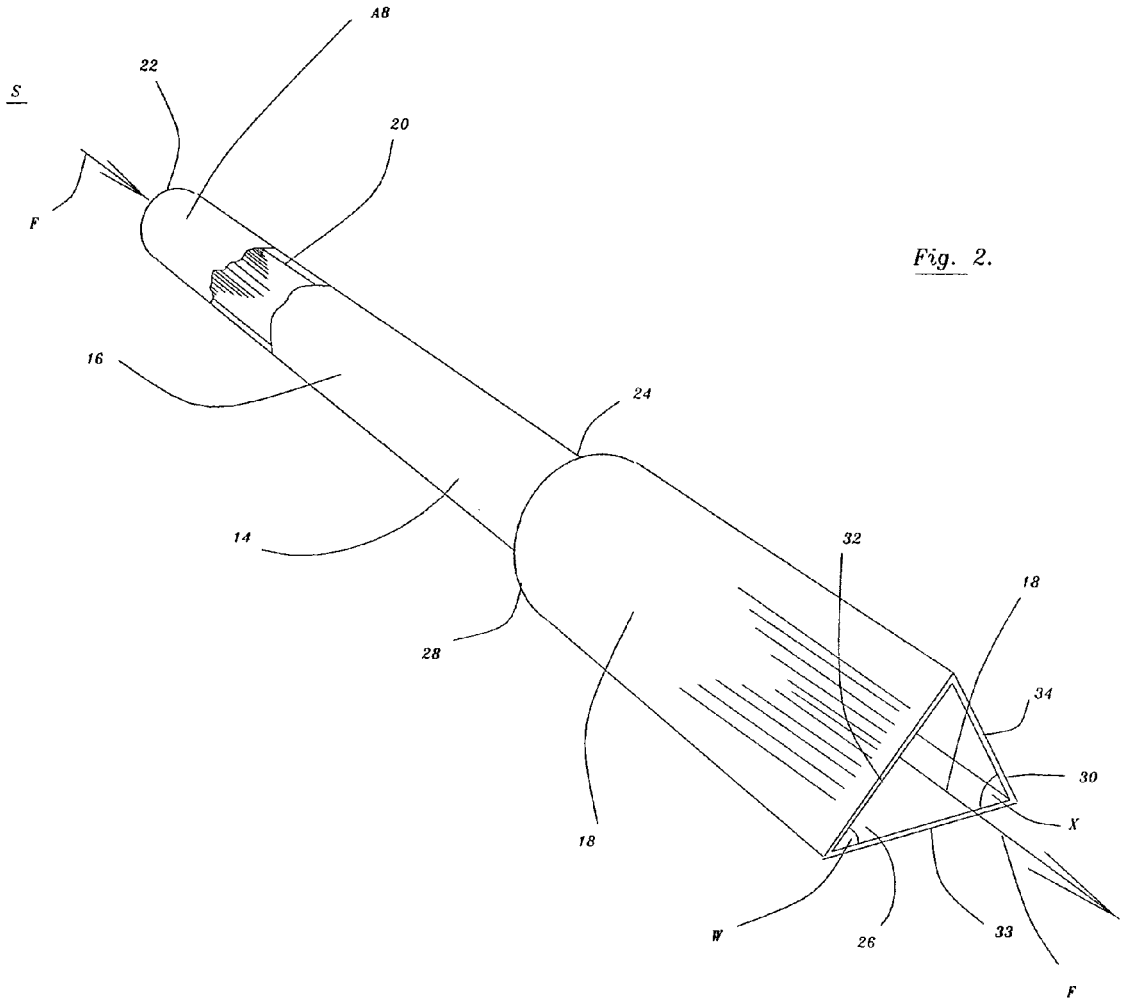
FIG. 2 is a perspective view of a tube shown in FIG. 1.

FIG. 2 is a perspective view of the tube 14 shown in FIG. 1. As shown in FIG. 2, the tube 14 has a first and a second portion 16 and 18 respectively for the flow therethrough of the stock S as indicated by the arrow F. The first portion 16 defines a bore 20 for the flow F therethrough of the stock S, the bore 20 having an upstream end 22 and a downstream end 24. The second portion 18 defines a passage 26 for the flow F therethrough of the stock, the passage 26 having an upstream extremity 28 and a downstream extremity 30. The upstream extremity 28 of the passage 26 cooperates with the downstream end 24 of the bore 20 so that the stock flows as indicated by the arrow F from the upstream end 22 to the downstream end 24 of the bore 20 and then through the upstream extremity 28 and then the downstream extremity 30 of the passage 26. The downstream end 24 of the bore 20 has a cross-sectional area which is less than a further cross-sectional area of the upstream extremity 28 of the passage 26. Also, the downstream extremity 30 of the passage 26 has a cross-section of triangular configuration.

In a more specific embodiment of the present invention, the tube 14 is fabricated from metal.

More specifically, the tube 14 is fabricated from stainless steel.

Additionally, the bore 20 is of uniform cross-sectional area from the upstream end 22 to the downstream end 24 thereof.

Also, the bore 20 is of circular cross-section from the upstream end 22 to the downstream end 24 thereof.

The upstream extremity 28 of the passage 26 is of circular cross-sectional configuration and the area of the circular cross-sectional configuration of the upstream extremity 28 is slightly greater than the cross sectional area of the downstream extremity 30 which is of triangular cross-sectional configuration.

Furthermore, the triangular configuration of the downstream extremity 30 of the passage 26 includes a first edge 32, second edge 33 and third edge 34

Additionally, a first angle W is defined between the first edge 32 and the second edge 33. Also, a second angle X is defined between the second edge 33 and the third edge 34. The sum of the first angle W and the second angle X is less than 180 degrees As shown in FIG. 1, a plurality of further tubes 36, 37 and 38 is provided with each further tube 36-38 being substantially identical in configuration to the tube 14.

The tube 14 and a laterally adjacent further tube 36 of the plurality of further tubes 36-38 are nested relative to each other with the further tube 36 being inverted relative to the tube 14 so that any disturbances generated within each tube 14 and 36-38 prior to discharge of the flow F of stock from the tubes 14 and 36-38 is minimized when the stock exits the tubes.

Moreover, the first edge 32 of the tube 14 is disposed congruently adjacent to the first edge 32' of the adjacent further tube 36.

As shown in FIG. 1 the apparatus 10 also includes an edge tube 40.

Figure 3:
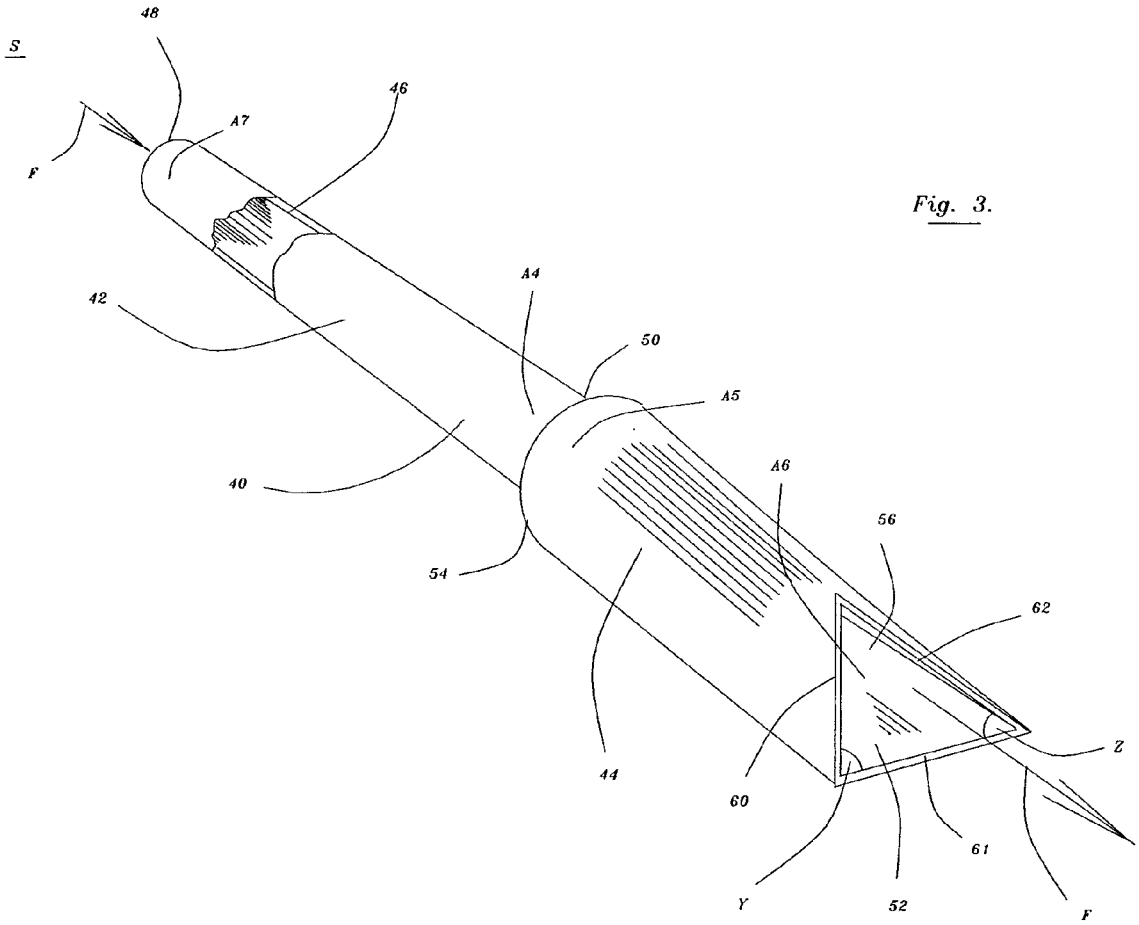
FIG. 3 is a perspective view of an edge tube shown in FIG. 2.

FIG. 3 is a perspective view of the edge tube 40 shown in FIG. 1. As shown in FIG. 3, the edge tube 40 has a first part 42 and a second part 44 for the flow F therethrough of the stock S. The first part 42 defines a channel 46 for the flow F therethrough of the stock S. The channel 46 has an upstream termination 48 and a downstream termination 50.

The second part 44 defines a conduit 52 for the flow F therethrough of the stock S. The conduit 52 has an upstream boundary 54 and a downstream boundary 56. The upstream boundary 54 of the conduit 52 cooperates with the downstream termination 50 of the channel 46 so that the stock S flows as indicated by the arrow F from the upstream termination 48 to the downstream termination 50 of the channel 46 and then through the upstream boundary 54 and then the downstream boundary 56 of the conduit 52.

Also, the downstream termination 50 of the channel 46 has a cross-sectional area A4 which is less than a further cross-sectional area AS of the upstream boundary 54 of the conduit 52.

Furthermore, the downstream boundary 56 of the conduit 52 has a cross-sectional area A6 of triangular configuration.

Also, the upstream termination 48 of the edge tube 40 has a cross sectional area A7 which is larger than a cross sectional area A8 as shown in FIG. 2 of the upstream end 22 of the bore 20 of the tube 14.

The downstream boundary 56 of the conduit 52 includes a first side 60, second side 61 and a third side 62.

Additionally, the second side 61 defines an angle Y relative to the first side 60.

Also, the third side 62 defines a further angle Z relative to the second side 61. As shown in FIG. 1, the angle Y and the further angle Z are different from each other so that the edge tube 40 nests between a pond side 64 of the headbox 12 and an adjacent edge 34' of an adjacent tube 36.

More specifically, the first side 60 of the edge tube 40 is vertical so that it cooperates and lies flat against the pond side 64. Also, the third side 62 is not vertical so that the third side 62 of the edge tube 40 cooperates with the third edge 34' of the tube 36 thereby minimizing the edge or wall effect of the edge tube 40 and the tube 36 when the stock S exits from the tubes 40 and 36.

In operation of the tube bank apparatus 10, pressurized stock S flows through the upstream end 22 of each tube 14-36-38 of the tube bank apparatus 10. The stock S also flows through the edge tube 40 disposed adjacent to the pond side 64. Stock S will also flow through a corresponding edge tube (not shown) disposed on the opposite pond side of the headbox 12.

Due to the triangular shape of the downstream extremities 30 of the tubes 14-36-38, the first edge 32, 32' and third edge 34, 34' will not be disposed parallel to each other or to the pond side 64 of the headbox 12. Consequently, the wall effects of the individual tubes 14-36-38 and on the distribution of the stock S on exiting the tubes 14-36-38 will be minimized.

Additionally, by providing the edge tubes 40 with at least one side such as side 62 with a disposition that is not parallel to the pond side 64, any edge effect caused by flow of stock out of the edge tube 40 is also minimized.

The present invention provides a unique headbox tube bank apparatus which minimizes the wall effect of the tubes and the side effect of the tubes and edge tubes on stock flowing out of the tubes.

What is claimed is:

1. A tube bank apparatus for distributing stock in a headbox of a papermaking machine, said apparatus comprising:

a tube having a first and a second portion for the flow therethrough of the stock;

said first portion defining a bore for the flow therethrough of the stock, said bore having an upstream and a downstream end;

said second portion defining a passage for a flow therethrough of the stock, said passage having an upstream and a downstream extremity, said upstream extremity of said passage cooperating with said downstream end of said bore so that the stock flows from said upstream end to said downstream end of said bore and then through said upstream extremity and then said downstream extremity of said passage; and a first, second and third edge defining at least a part of said downstream extremity of said passage, said second edge extending between said first edge and said third edge such that a sum of a first angle defined between said first edge and said second edge and a second angle defined between said second edge and said third edge is less than 180 degrees so that wall effects of said tube on the distributing of the stock exiting said tube is minimized.

2. A tube bank apparatus as set forth in claim 1 wherein said downstream extremity of said passage is of triangular cross sectional configuration.

3. A tube bank apparatus as set forth in claim 1 wherein said tube is fabricated from metal.

4. A tube bank apparatus as set forth in claim 1 wherein said tube is fabricated from stainless steel.

5. A tube bank apparatus as set forth in claim 1 wherein said bore is of uniform cross-sectional area from said upstream end to said downstream end thereof.

6. A tube bank apparatus as set forth in claim 1 wherein said bore is of circular cross-section from said upstream end to said downstream end thereof.

7. A tube bank apparatus as set forth in claim 6 wherein said bore is of uniform cross-sectional area from said upstream end to said downstream end thereof.

8. A tube bank apparatus as set forth in claim 1 wherein said upstream extremity of said passage is of circular cross-sectional configuration.

9. A tube bank apparatus as set forth in claim 8 wherein said circular cross-sectional configuration of said upstream extremity of said passage has an area which is greater than a further area of a cross-section of said downstream extremity of said passage so that said flow of the stock accelerates between said upstream and said downstream extremities of said passage.

10. A tube bank apparatus as set forth in claim 1 wherein said first angle defined between said first edge and said second edge is approximately equal to said second angle defined between said second edge and said third edge.

11. A tube bank apparatus as set forth in claim 10 further including:

a plurality of further tubes, each further tube being substantially identical in configuration to said tube;

said tube and a laterally adjacent further tube of said plurality of further tubes being nested relative to each other with said adjacent further tube being inverted relative to said tube so that any disturbances generated within each tube prior to discharge of the flow of stock from said tubes is minimized on flowing out from said tubes.

12. A tube bank apparatus as set forth in claim 11 wherein said first edge of said tube is disposed congruently adjacent to said first edge of said adjacent further tube.

13. A tube bank apparatus as set forth in claim 1 further including:

an edge tube having a first and a second part for the flow therethrough of the stock;

said first part defining a channel for the flow therethrough of the stock, said channel having an upstream and a downstream termination;

said second part of said edge tube defining a conduit for the flow therethrough of the stock, said conduit having an upstream and a downstream boundary, said upstream boundary of said conduit cooperating with said downstream termination of said channel so that the stock flows from said upstream termination to said downstream termination of said channel and then through said upstream boundary and then said downstream boundary of said conduit;

said downstream termination of said channel having a cross-sectional area which is less than a further cross-sectional area of said upstream boundary of said conduit;

said downstream boundary of said conduit having a cross-section of triangular configuration;

said upstream termination of said edge tube having a larger cross sectional area than said cross sectional area of said upstream end of said tube;

a first, second and third side defining at least a part of said downstream boundary of said conduit, said second side extending between said first side and said third side such that a sum of an angle defined between said first side and said second side and a further angle defined between said second side and said third side is less than 180 degrees.

14. A tube bank apparatus for distributing stock in a headbox of a papermaking machine, said apparatus comprising:

a tube having a first and a second portion for the flow therethrough of the stock;

said first portion defining a bore for the flow therethrough of the stock, said bore having an upstream and a downstream end;

said second portion defining a passage for the flow therethrough of the stock, said passage having an upstream and a downstream extremity, said upstream extremity of said passage cooperating with said downstream end of said bore so that the stock flows from said upstream end to said downstream end of said bore and then through said upstream extremity and then said downstream extremity of said passage;

said downstream end of said bore having a cross-sectional area which is less than a further cross-sectional area of said upstream extremity of said passage;

said downstream extremity of said passage having a cross-section of triangular configuration;

said triangular configuration of said downstream extremity of said passage including:

a first, second and third edge; and a first angle defined between said first edge and said second edge being approximately equal to a second angle defined between said second edge and said third edge so that wall effects of said tube on the distributing of the stock exiting said tube is minimized.

15. A tube bank apparatus for distributing stock in a headbox of a papermaking machine, said apparatus comprising:

a tube having a first and a second portion for the flow therethrough of the stock;

said first portion defining a bore for the flow therethrough of the stock, said bore having an upstream and a downstream end;

said second portion defining a passage for the flow therethrough of the stock, said passage having an upstream and a downstream extremity, said upstream extremity of said passage cooperating with said downstream end of said bore so that the stock flows from said upstream end to said downstream end of said bore and then through said upstream extremity and then said downstream extremity of said passage;

said downstream end of said bore having a cross-sectional area which is less than a further cross-sectional area of said upstream extremity of said passage;

said downstream extremity of said passage having a cross-section of triangular configuration;

said tube being fabricated from stainless steel;

said bore being of uniform cross-sectional area from said upstream end to said downstream end thereof;

said bore being of circular cross-section from said upstream end to said downstream end thereof;

said upstream extremity of said passage being of circular cross-sectional configuration;

said circular cross-sectional configuration of said upstream extremity having an area which is greater than a further area of said cross-section of triangular configuration;

said triangular configuration of said downstream extremity of said passage including:

a first, second and third edge;

a first angle defined between said first edge and said second edge being approximately equal to a second angle defined between said second edge and said third edge;

a plurality of further tubes, each further tube being substantially identical in configuration to said tube;

said tube and a laterally adjacent further tube of said plurality of further tubes being nested relative to each other with said adjacent further tube being inverted relative to said tube so that any disturbances generated within each tube prior to discharge of the flow of stock from said tubes is minimized when the stock flows out of the tubes so that wall effects of said tube on the distributing of the stock exiting said tube is minimized;

an edge tube having a first and a second part for the flow therethrough of the stock;

said first part defining a channel for the flow therethrough of the stock, said channel having an upstream and a downstream termination;

said second part defuiing a conduit for the flow therethrough of the stock, said conduit having an upstream and a downstream boundary, said upstream boundary of said conduit cooperating with said downstream termination of said channel so that the stock flows from said upstream termination to said downstream termination of said channel and then through said upstream boundary and then said downstream boundary of said conduit;

said downstream termination of said channel having a cross-sectional area which is less than a further cross-sectional area of said upstream boundary of said conduit;

said downstream boundary of said conduit having a cross-section of triangular configuration;

said upstream termination of said channel having a larger cross sectional area than said cross sectional area of said upstream end of said tube;

said downstream boundary of said conduit including:

a first, second and third side;

said first side defining a first angle relative to said second side; and said second side defining a second angle relative to said third side, said first and second angles being different from each other so that said edge tube nests between a pond side of the headbox and an adjacent edge of an adjacent tube.

* * * * *

UNITED STATES PATENT AND TRADEMARK OFFICE

CERTIFICATE OF CORRECTION

PATENT NO. : 8,795,473 B2
APPLICATION NO. : 12/589318
DATED : August 5, 2014
INVENTOR(S) : Laurie D Wicks, Greg Welcher and James L Ewald It is certified that error appears in the above-identified patent and that said Letters Patent is hereby corrected as shown below:

Title Page, item [75], inventor Greg Weicher should read Greg Welcher.

In the Specification

Column 5, line 21, AS should read A5.

Signed and Sealed this
Fourth Day of November, 2014

Michelle K. Lee

Michelle K. Lee
*Deputy Director of the United States Patent and Trademark Office*